US005845740A

United States Patent [19]

Bouwkamp

[11] Patent Number: 5,845,740

[45] Date of Patent: Dec. 8, 1998

[54] FIREFIGHTER'S ROOF SUPPORT

[76] Inventor: Jack Bouwkamp, 303 6th St., Collingwood, Canada, 1Z4

[21] Appl. No.: 24,038

[22] Filed: Feb. 16, 1998

[51] Int. Cl.[6] ..... A47G 29/02

[52] U.S. Cl. ..... 182/45; 248/237

[58] Field of Search ..... 182/45, 129; 248/237

[56] References Cited

U.S. PATENT DOCUMENTS

| | | | |
|---|---|---|---|
| 530,165 | 12/1894 | Donovan . | |
| 789,039 | 5/1905 | Jones . | |
| 1,006,562 | 10/1911 | Kefover . | |
| 1,143,555 | 6/1915 | Schimmelpfennig | 182/45 |
| 1,152,685 | 9/1915 | Winn . | |
| 1,363,864 | 12/1920 | Grush | 182/45 |

FOREIGN PATENT DOCUMENTS

| | | | |
|---|---|---|---|
| 28178 | 5/1903 | Switzerland | 182/45 |

*Primary Examiner*—Alvin Chin-Shue

[57] ABSTRACT

This invention provides a roof support upon which a firefighter or other user can stand. The support fits tightly against a sloped roof, thus the support is wedge shaped. At the upper portion of the support is a standing surface upon which the user will be supported. The roof support is locked into place on a sloped roof by inserting a T-bar attached to a chain into a hole in the roof. Once the T-bar is inserted, it is pulled up against the inner surface of the roof and locked into place by attaching a plug on the opposite end of the chain to a locking device on the roof support.

15 Claims, 6 Drawing Sheets

FIREFIGHTER'S ROOF SUPPORT

This application relates to a support useful to firefighters when they are positioned on a roof and more specifically to a roof support that can easily support a firefighter in a secure manner.

BACKGROUND OF THE INVENTION

When a structure such as a domestic or business building is on fire, it is important for firefighters to make a hole in the roof to allow smoke to escape from the structure. This is a safety precaution that is taken to allow smoke to easily exit, especially if people who may be in the building could be adversely affected by the smoke. Additionally, the ventilation of smoke minimizes the possibility of a smoke explosion. It is highly desirable to have ventilation through several smoke exit means including primarily through the roof.

It is common practice today for firefighters who climb a roof to axe a hole in the roof, to use a ladder than can be somehow secured to a roof peak. Once the ladder has been secured to the roof, the firefighter will stand on and support himself on the rungs of the ladder. He will then use his axe to cut a hole in the roof at a location to the side of the ladder. This is generally an awkward standing and working position for the firefighter since he must swing the axe to the side of his position of the ladder. Since time is always an important factor in this type of ventilation process, anything that could safely expedite the firefighter's procedure would be a major step forward in the art.

There are various pieces of equipment that can be used today for anchoring roof supports. Some of these are disclosed in U.S. Pat. Nos. 19,700 (Kennedy); 462,849 (McComack); 568,003 (Shirer); 4,226,058 (Riley) and 5,570,864 (Flores).

The Kennedy device comprises a metal bolt with a head, the bolt is of sufficient length to pass through the upright part of a bracket for the side of a building. Also provided on the bracket is means on the lower bracket side for attachment to the roof of a building. A dog or pawl is provided with the bolt to hold and secure carpenter's brackets as fasteners to the building. The use of the Kennedy structure requires that a hole be drilled into the side or roof to support a bracket. The pawl or dog is not very large and could pull out if not set up properly. The device of Kennedy would not be acceptable for firefighting usage since it would take too long to install.

In U.S. Pat. No. 462,849 (McComack) a roof scaffold is described and claimed. McComack's device is specifically designed for use by workmen on the roofs of buildings for painting, shingling or repairing the roof. The scaffold described has a platform seat or platform positioned on a supporting structure. This platform is ordinarily a plank resting by its opposite ends on end brackets. The workmen are supported on a moveable platform, which is traversed up or down as the roof section being worked upon is completed. McCornack uses a hook on a rope to secure the platform to roof boards. Not only would this type of support take too long for a firefighter to install, but it depends upon roof boards that could be weak or have knot holes. These defects could cause the securing hooks to pull out, thereby losing the hold for the structure. Also, the movable plank could dislodge and cause a serious potential problem for the firefighter.

Shirer teaches the use of a roofing bracket that comprises a flat bar which fits against the roof and which forms the base for the structure. The base has bars E and F that are raised therefrom in a triangular configuration with the triangle base being the flat bar resting on the roof. A scaffold-board is then placed upon the horizontal bar E and secured thereon by a bolt or pin or other means. The device is held in place by nails connecting the base to the roof. Shirer's staging bracket is for use with planking where workers could stand on it while shingling a roof. As noted, it is merely nailed to a roof with ordinary nails which would be cumbersome for firefighters with bulky gloves and heavy equipment to install. Also it would be very time consuming and because of the movable board, could be a problem for a firefighter to use when fire is rapidly consuming a structure.

Riley U.S. Pat. No. 4,226,058 discloses a roof anchor for securing a bracket to a roof. The anchor consists of an anchor bolt which has a hooked end with a terminal hook end portion off-set from the vertical axis of the main stem. To use Riley's device, a hole is made in a roof and the anchor bolt is inserted therein and extended down into the roof until it encounters a beam 20. It is then secured around beam 20 by its lower hooked portion. The upper section of the bolt which is threaded is then connected to a roof plate 30. Riley's patent merely describes a hooked bolt for supporting equipment on a roof. This hook must be hooked under a roof rafter or joist by a worker in the attic. This type of structure would not be practical for a firefighter to use when he or she climbs on a roof to axe a ventilation hole in the roof Flores U.S. Pat. No. 5,570,864 discloses an adjusting roofing stool comprising a movable plate which is rectangular with a planar surface adapted to support a person or materials. Attached to the plate or seat are a pair of legs which are triangular in structure. The legs have adjustment holes for raising or lowering the seat. The structure of Flores has a bottom surface adapted to be placed in contact with the surface of a pitched roof. Holding Flores structure in place is a hinge which on one end is connected to the bottom surface of the stool and at the other end has means for connection to the surface of a pitched roof. As in the other prior art patents above discussed the time required to set them up is too long. Also nailing a hinge to a roof is not too secure, especially if a firefighter with heavy equipment is supported thereon and swinging an axe. Again, with large gloves, a firefighter would have a difficult time nailing or screwing a hinge to a roof. The movable plate 52 of Flores could accidentally move when in use, thereby causing a potential danger to the user.

In summary, the prior art aware of and discussed herein disclose supports that would be dangerous for a firefighter to rely upon, would take too long to install, and would be difficult to nail or screw into an inclined roof surface.

SUMMARY OF THE INVENTION

It is therefore an object of this invention to provide a roof support devoid of the above noted disadvantages.

Another object of this invention is to provide a roof support easy to install and at the same time very secure and stable.

Yet another object of this invention is to provide a roof support that can rapidly be installed and can support a very heavy load.

Still a further object of this invention is to provide a roof support that is easily adjusted and installed even for users having heavy gloves and wearing heavy equipment.

Also a further object of this invention is to provide a roof support that is light enough to be easily carried by firefighters or repairmen, yet very strong and secure when installed on a sloping roof surface.

Another still further object of this invention is to provide a roof support especially designed for use by a firefighter when putting a ventilating hole in a roof of a burning building.

Yet still a further object of this invention is to provide a strong, secure and easily transportable roof structure that is relatively simple to use and inexpensive to manufacture.

These and other objects of this invention are accomplished generally speaking by providing a sturdy, wedge-shaped support designed so that the support could lie on a sloped roof and provide one surface to be approximately level. The support unit is constructed of steel and strong but is easily carried by a firefighter or other user. The unit is placed on the roof and the bottom surface contains several spikes to dig into the roof for positioning. On the upper surface, a chain and dog unit would be attached that would allow the dog (T-bar or restraining rod) to be placed under the roof through a hole placed in the roof. After the firefighter (or other user) has poked a hole in the roof for it to be inserted, a chain would tighten to a key slot in the fastening attachment to hold the unit in place. The support or unit would be retained by the chain and dog while the spikes on the bottom surface are used for additional support. Thus, there are two securing means for the support, one the chain and dog and secondly the bottom spikes or cleats that dig into the outer surface of the roof.

Generally, the present structure uses a T-bar that passes through the roof line, it is attached to a chain that is secured to platform with a hole and slot. The chain is secured in the slot with a plug that goes into a hole that runs through to stop it from slipping out of slot. None of the above discussed patents use this method of securing a platform to the roof. The chain can be adjusted to suit different situations or conditions; i.e., snow, freezing rain. With the use of T-bar under the roofline, a much greater surface area for holding is provided and there is very little, if any, chance of the bar pulling out of roof. This is a much more secure platform to work on. Also with an optional D-ring provided on the platform, it gives firefighters a point at which to hook up a safety belt if needed, thereby adding an extra safety measure. The support of this invention is also applied to the roof very expediently. It has been applied in a 20-to-30 second time frame with full firefighting equipment on. This expediency is crucial when ventilation of a building is required. To apply the unit, a small hole must be made with pickend of a fire axe, approximate diameter of 1½", to allow T-bar to be inserted into the roof. This damage is minimal because the reason the firefighter is on the roof is to make a large hole approximately 4 feet by 4 feet to ventilate the building. After the unit is in place and the chain is shortened to the desired length and secured with a plug in the hole where it passes to form the platform that is needed, it is important to make sure the platform is parallel to the roof line and then stamp one foot onto the platform to set cleats into roofing material, i.e., shakes, shingles, tin, etc. The cleat stops sideways movement and adds to the hold on the roof. Now work required to be done can be done safely and efficiently without having to lean out to left or right of a roof ladder as heretofore required. The use of an axe or chainsaw is much easier. All of the procedures stated are easily done with bulky gloves and full firefighting equipment on. The standing surface and all of the attached components such as the upwardly extending flange and the upwardly extending key slot device are rigidly connected, such as by welding, etc. None of the components attached to the standing surface are movable, thus minimizing the change of movement when in use. The only movable component in the support of this invention is the adjustable chain and its end attachments.

DETAILED DESCRIPTION OF THE DRAWING AND PREFERRED EMBODIMENTS

Figure 1:
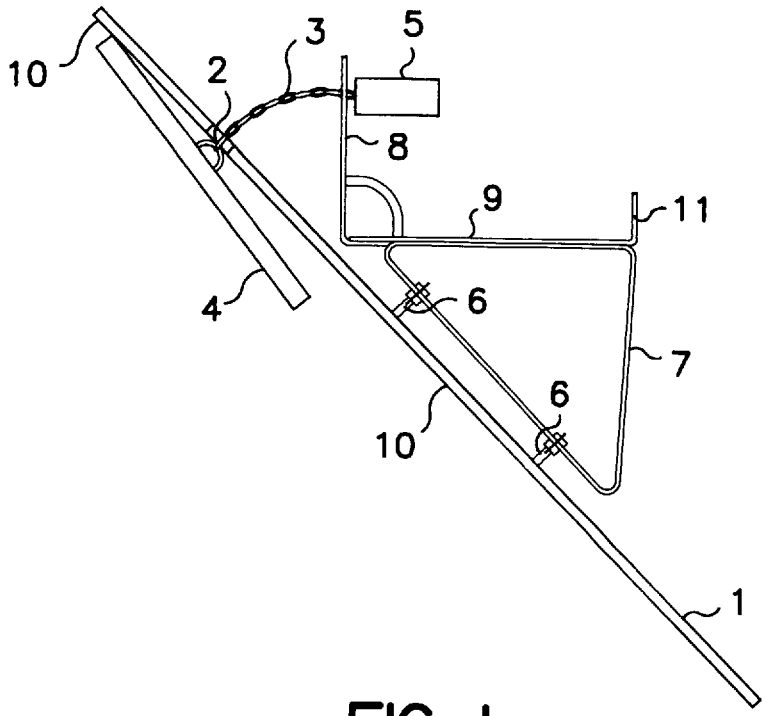
FIG. 1 is a plan view of the support of this invention when it is attached to a sloped roof.
Figure 2:
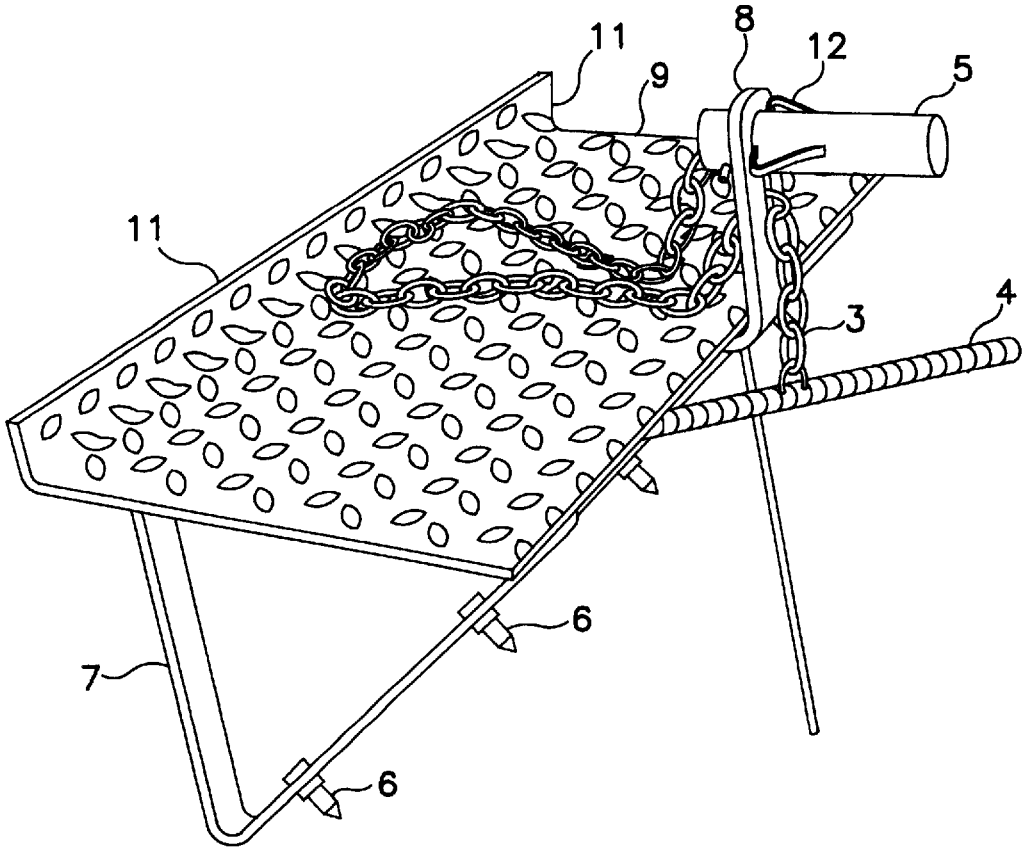
FIG. 2 is a perspective view of the support of this invention as it would appear after installation, but for clarity, the roof is not illustrated.

In FIG. 1 a slope roof 1 has a small hole 2 punched therethrough. To secure the illustrated support to roof 1, a T-bar or dog 4 which is attached to a chain 3 is inserted through the hole 2 and pulled up toward key slot 8 until dog or T-bar 4 is pulled tightly against the inside surface 10 of roof 1. Once dog 4 is tightly in place, chain 3 is pulled through key slot 8 and locked in place by the use of plug 5 which is attached to the end of chain 3. Chain 3 has on one end (lower end) a dog 4 and chain 3 has on the opposite end a lock plug 5. On the lower side of the support (closest to the roof) are positioned cleats 6 which dig into roof 1 to both further secure the support to the roof and also to prevent side-to-side movement of the roof support. Thus, there are two means to secure the support to a roof 1, first the cleats 6 which digs into the roof 1 and secondly the dog 4 and chain 3 which are locked firmly into key slot 8 by plug 5. However, the dog 4 and chain 3 are the primary securing means for the support. The triangular legs or runners 7 have on their lower sides cleats 6. Legs 7 support the horizontal surface 9 upon which the firefighter or user will stand. By "horizontal" is meant at a plane that is at a right angle to a vertical line when in use or installed. Once the firefighter is standing on horizontal level surface 9 he or she can easily axe a ventilation hole in the roof at any location while swinging the axe in a normal (rather than to the side) motion. In FIG. 2 a perspective view of the support of this invention is illustrated having a flat approximately level non-skid surface 9 upon which the user will stand. Surface 9 has an upwardly extending flange 11 to provide insurance that the users feet don't slip off surface 9. Triangular shaped legs 7 support surface 9 and contain cleats or spikes 6 on their face that will contact the outer surface of roof 1. Once the T-bar is pulled up tightly against the inside surface 10 of roof 1, chain 3 is locked into key slot device 8 and the chain is located off surface 9. The drawing shows chain 3 on surface 9 for clarity; however, in use chain 3 would be off surface 9 so surface 9 is clear of any obstructions or impediments. Plug 5 has spring loaded pinch clamps 12 which are pinched closed to insert through the key slot, then released to lock plug 5 into key slot device 8. The standing platform or surface 9 has a rigidly connected upwardly extending flange 11 and a rigidly connected key slot device 8 to ensure that nothing will move once the support is in use. By "rigid" is meant no moving parts or components, the standing surface 9 is rigid, as are the rigidly connected components 8 and 11. "Rigid" means immovable.

Figure 3:
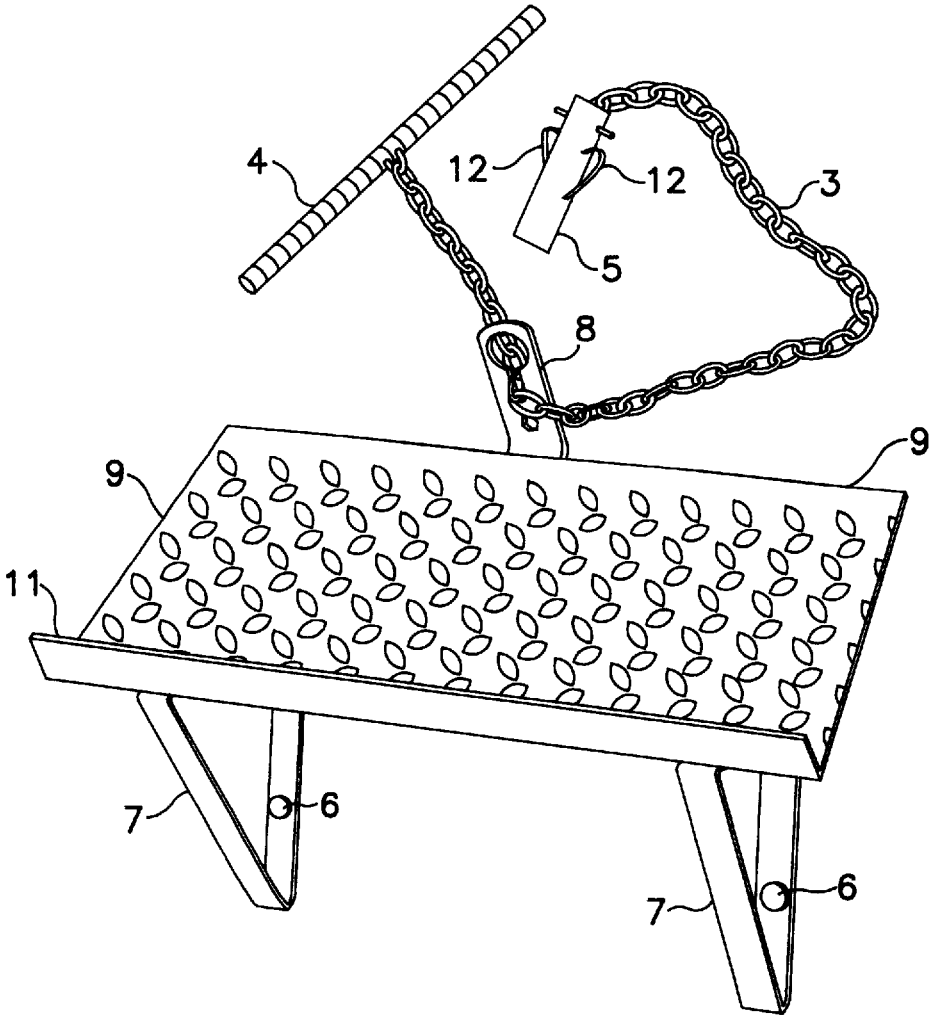
FIG. 3 is a perspective view showing the components of the support of this invention.
Figure 4:
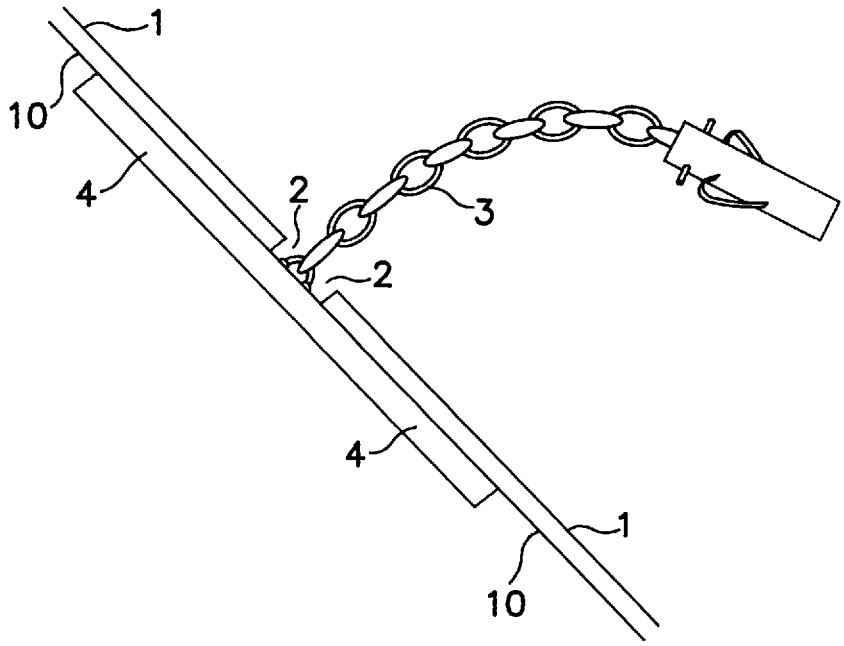
FIG. 4 is a plan view showing the location of the dog or retaining rod when the support is installed.
Figure 5:
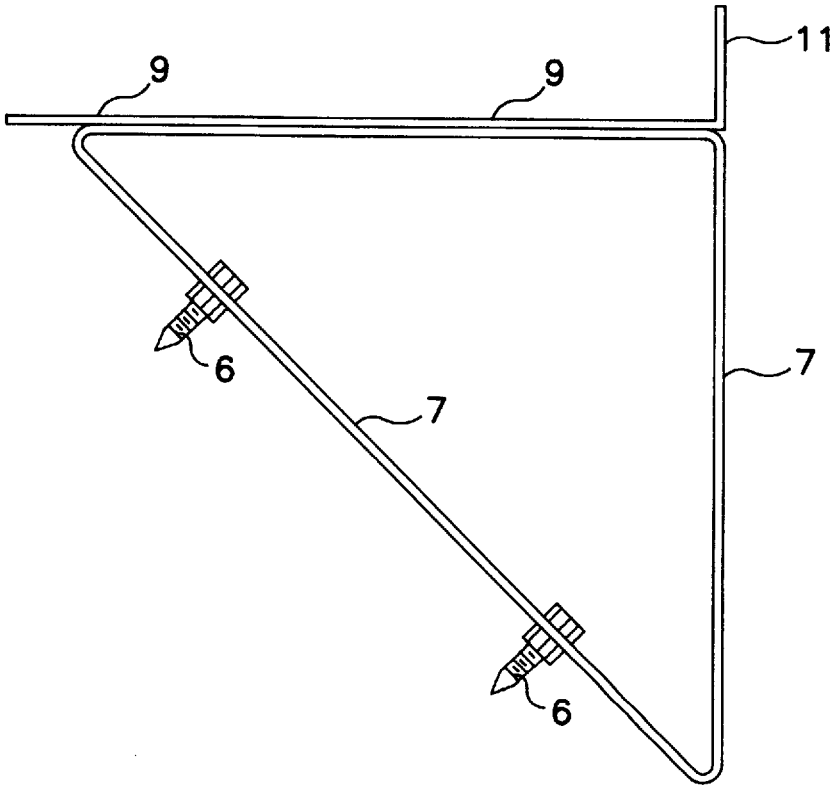
FIG. 5 is a plan view showing the location of the cleats or spikes on the triangular legs of the support of this invention.
Figure 7:
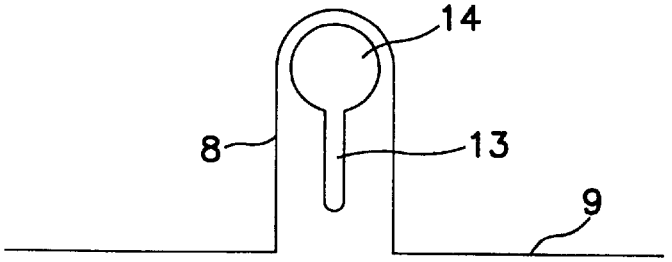
FIG. 7 is a plan view of the key or chain slot used to lock the support in place.
Figure 6:
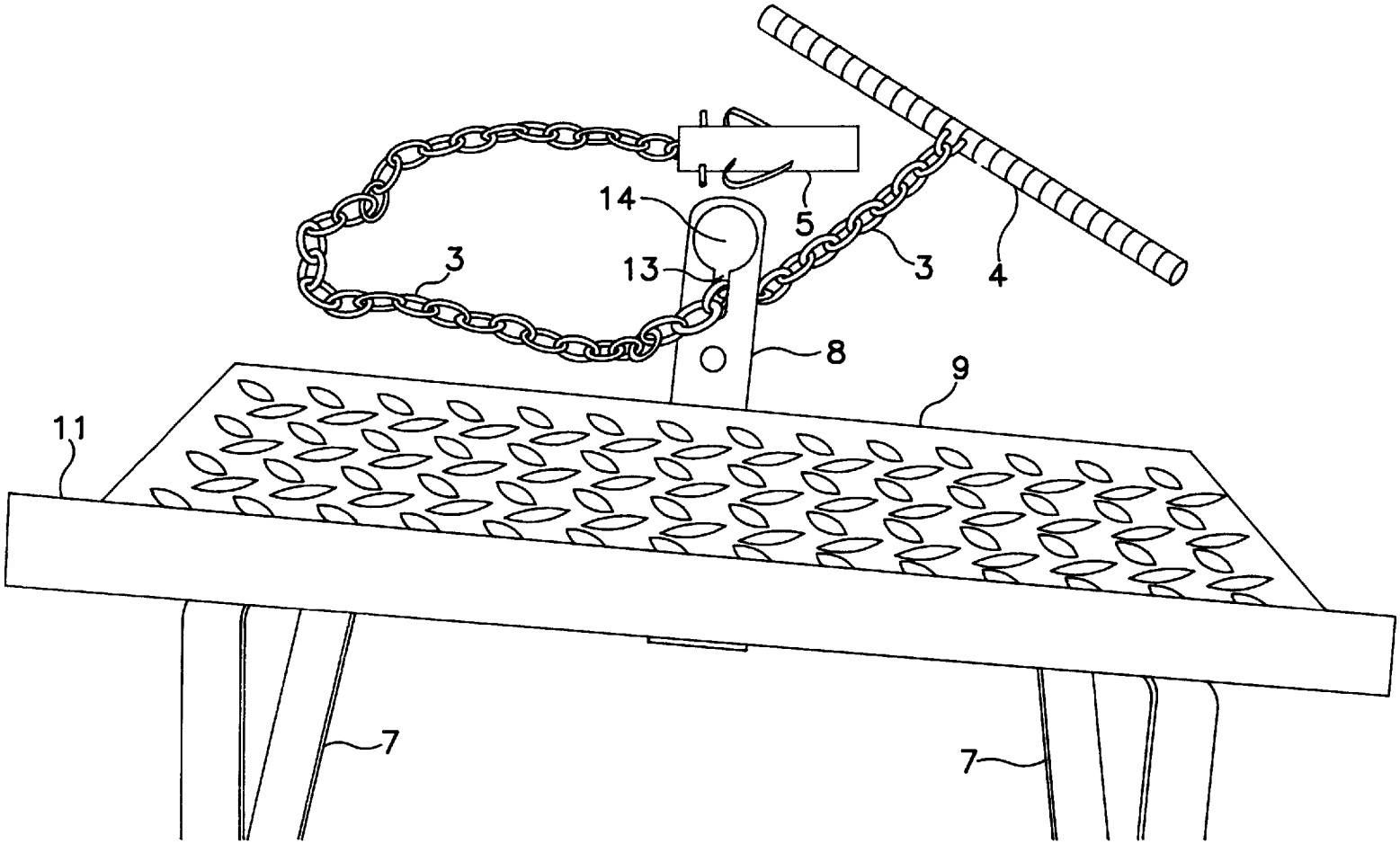
FIG. 6 is a perspective view showing the T-bar, chain, key slot and retaining plug used to lock the support in place.

In FIG. 3 a top perspective view of the roof support is illustrated showing the major components of the roof support of this invention. Non-skid standing surface 9 is shown with flange 11 on one side and on the opposite side of surface 9 is an upwardly extending key slot structure 8. Chain 3 is fitted through an aperture in key slot structure 8, chain 3 having on one end T-bar 4 and on the opposite end of chain 3 is plug 5 with spring loaded pinch clamps 12. Supporting the standing surface 9 are triangular shaped legs 7 which have cleats 6 on the leg portion that contact the outside surface of roof 1. An extremely important feature of this invention is the integrity of the roof securing means used to attach the support to roof 1; the chain T-bar, key slot and plug means provide the main securing means bolstered by the cleat 6 retaining means. In FIG. 4 the location of the T-bar 4 when in a locked position is shown when installed. The T-bar 4 and chain 3 are inserted through the aperture or roof hole 2, then pulled upwardly until T-bar is against the inside surface 10 of the roof 1. Once the T-bar is in place tightly the plug 5 is pulled through the aperture in key slot device 8 and the chain pushed down into the key slot 13 (as seen in FIG. 7) to lock a link of chain 3 in place. Chain 3 will not move or dislodge once it is positioned in key slot 13. In FIG. 5 a side plan view of the standing surface 9 and legs 7 is shown. Standing surface 9 has an upwardly extending flange 11 which provides a guard against the users feet slipping off surface 9. Cleats 6 project downward from triangular legs 7 and are secured thereto by conventional means, such as welding, nut and bolt, etc. On the side of surface 9 opposite the side with the flange 11 is located the key slot device 8 which is not shown in this figure only for clarity. The angle of legs 7 can be determined so as to conform to the slope of the roof upon which it will be used. The length of cleats 6 will also vary depending upon the thickness of the roof surface to be penetrated. In FIG. 6 the standing non-skid surface 9 is shown having a flange 11 on one longitudinal side and a key slot device 8 on the opposite longitudinal side. The link of chain 3 is shown locked into lower keyhole or slot 13 were it cannot move unless pulled out. Upper keyhole slot 14 is used to insert the lock plug 5 to further ensure the locking of a link of chain 3 in place. Plug 5 is shown with pinch clamps 12 for entering and subsequent locking in the upper keyhole slot 14.

In FIG. 7 the keyhole device 8 is shown in an enlarged form. The keyhole device 8 comprises an upper aperture or slot 14 and a lower slot 13. The link of chain 3 is locked into lower slot 13 as shown in FIG. 6 and the plug 5 attached to an end of chain 3 is locked into upper slot 14 as shown in FIG. 2. The dimensions of lower slot 13 should be smaller than the thickness of a chain link in order to ensure that the link cannot pass through lower slot 13 when locked therein.

The preferred and optimumly preferred embodiments of the present invention have been described herein and shown in the accompanying drawing to illustrate the underlying principles of the invention, but it is to be understood that numerous modifications and ramifications may be made without departing from the spirit and scope of this invention.

I claim:

1. A roof support having means for supporting a person on a sloped roof comprising in combination a substantially horizontal and rigid standing surface, at least a pair of substantially parallel symmetrically shaped legs supporting said standing surface, and a chain having means for locking said roof support in place on said roof, said standing surface having rigidly connected thereto and on one edge thereof an upwardly extending key lock device, said chain having attached thereto on one terminal end a T-bar and on an opposite terminal end a lock plug, said T-bar having means to be inserted into a hole in said roof and means to be locked therein, said plug having means to fit into and lock into said key lock device.

2. The roof support of claim 1 wherein said key lock device comprises an upper key slot and a low key slot.

3. The roof support of claim 1 wherein said plug has means to lock into an upper key slot in said key lock device.

4. The roof support of claim 1 wherein said chain has link means to lock into a lower key slot in said key lock device.

5. The roof support of claim 1 wherein said standing surface has rigidly connected thereto an upwardly extending flange on a longitudinal edge opposite said key lock device.

6. The roof support of claim 1 wherein said legs have a plurality of cleats positioned on a leg portion that will abut a roof surface.

7. The roof support of claim 1 wherein said T-shaped bar has means to allow it to be placed under a roof through a hole located in said roof and means to be pulled up against an inside surface of said roof.

8. The roof support of claim 1 wherein said lock plug has integral therewith at least a pair of spring loaded pinch clamps with means for locking into said key lock device.

9. The roof support of claim 1 wherein said key lock device is rigidly positioned on said standing surface and extends upwardly therefrom on substantially a vertical plane.

10. A substantially wedge-shaped roof support having means for fitting flush against a sloped roof, said support comprising in combination a substantially rectangular, rigid and horizontal standing non-skid surface, at least a pair of substantially parallel legs to support said standing surface, and a chain having means for locking said support securely in place on said roof, said standing surface having rigidly connected to and integral therewith and on one edge thereof an upwardly extending key lock device or component, said standing surface having rigidly connected thereto on a second edge thereof an upwardly extending flange, said chain having on one terminal end thereof a T-bar and on an opposite terminal end thereof a lock plug, said T-bar having means to be inserted into a hole in said roof and means to be locked therein, said plug having means to fit into and lock into said key lock device and wherein said key lock device comprises an upper key slot and a low key slot.

11. The roof support of claim 10 wherein said standing surface has rigidly connected thereto an upwardly extending flange on a longitudinal edge opposite said key lock device.

12. The roof support of claim 10 wherein said legs have a plurality of cleats positioned on a leg portion that will abut a roof surface.

13. The roof support of claim 10 wherein said T-shaped bar has means to allow it to be placed under a roof through a hole located in said roof and means to be pulled up against an inside surface of said roof.

14. The roof support of claim 10 wherein said lock plug has integral therewith at least a pair of spring loaded pinch clamps with means for locking into said key lock device.

15. The roof support of claim 10 wherein said key lock device is positioned on said standing surface and extends upwardly therefrom on substantially a vertical plane.

* * * * *